US009095180B1

(12) United States Patent
Lovett

(10) Patent No.: US 9,095,180 B1
(45) Date of Patent: Aug. 4, 2015

(54) APPARATUS FOR FORMING A SIMULATED NECKTIE

(71) Applicant: Clyde Lovett, Long Beach, CA (US)

(72) Inventor: Clyde Lovett, Long Beach, CA (US)

( * ) Notice: Subject to any disclaimer, the term of this patent is extended or adjusted under 35 U.S.C. 154(b) by 0 days.

(21) Appl. No.: 14/120,343

(22) Filed: May 15, 2014

(51) Int. Cl.
*A41D 25/08* (2006.01)
*A41D 25/00* (2006.01)

(52) U.S. Cl.
CPC ..... *A41D 25/08* (2013.01); *A41D 25/00* (2013.01); *A41D 25/005* (2013.01)

(58) Field of Classification Search
CPC ... A41D 25/001; A41D 25/00; A41D 25/003; A41D 25/005; A41D 25/006; A41D 25/008; A41D 25/12; A41D 25/14; A41D 25/16; A41D 25/02; A41D 25/022; A41D 25/025; A41D 25/027; A41D 25/04; A41D 25/06; A41D 25/08; A41D 25/10
USPC ..... 2/144, 145, 146, 147, 148, 149, 150, 2/151, 152.1, 53, 154, 155, 156, 157
See application file for complete search history.

(56) References Cited

U.S. PATENT DOCUMENTS

| | | | | | |
|---|---|---|---|---|---|
| 1,438,885 | A | * | 12/1922 | Almedia | 2/153 |
| 1,959,801 | A | * | 5/1934 | Scharlin | 2/150 |
| 2,103,456 | A | * | 12/1937 | Hall | 2/150 |
| 2,133,169 | A | * | 10/1938 | Ve Relle | 2/150 |
| 2,244,692 | A | * | 6/1941 | Hall | 2/150 |
| 2,465,947 | A | * | 3/1949 | Ve Relle | 2/153 |
| 2,473,593 | A | * | 6/1949 | Lambrechts | 2/153 |
| 2,529,957 | A | * | 11/1950 | Newman | 2/153 |
| 2,728,081 | A | * | 12/1955 | Zele | 2/153 |
| 2,936,462 | A | * | 5/1960 | Williams, Jr. et al. | 2/150 |
| 3,235,880 | A | * | 2/1966 | Hypps | 24/66.3 |
| 3,284,807 | A | * | 11/1966 | Espino | 2/153 |
| 3,735,420 | A | * | 5/1973 | New | 2/150 |
| 3,745,614 | A | * | 7/1973 | Tsang | 2/148 |
| 3,898,698 | A | * | 8/1975 | Byrd et al. | 2/150 |
| 3,999,222 | A | * | 12/1976 | Walborn | 2/150 |
| 4,173,792 | A | * | 11/1979 | Intengan | 2/144 |
| 4,542,537 | A | * | 9/1985 | Plapp et al. | 2/148 |
| 4,875,239 | A | * | 10/1989 | Patterson, Jr. | 2/153 |
| 4,897,887 | A | * | 2/1990 | Chen et al. | 2/150 |
| 5,010,593 | A | * | 4/1991 | Stevens, Jr. | 2/153 |
| 5,035,002 | A | * | 7/1991 | Knight, Jr. | 2/153 |
| 5,084,916 | A | * | 2/1992 | Austin | 2/149 |
| 5,216,757 | A | * | 6/1993 | Dorkin | 2/152.1 |
| 5,493,731 | A | * | 2/1996 | Amnott | 2/148 |
| 5,778,453 | A | * | 7/1998 | Chen | 2/148 |
| 5,953,755 | A | * | 9/1999 | Barylski | 2/148 |
| 6,094,746 | A | * | 8/2000 | Miller | 2/152.1 |
| 6,305,025 | B1 | * | 10/2001 | Pilon | 2/145 |
| 6,460,189 | B1 | * | 10/2002 | Welch | 2/145 |
| 6,691,319 | B1 | * | 2/2004 | Simon | 2/144 |
| 2003/0213047 | A1 | * | 11/2003 | I | 2/144 |
| 2003/0226189 | A1 | * | 12/2003 | Galante | 2/144 |

(Continued)

*Primary Examiner* — Alissa L Hoey
(74) *Attorney, Agent, or Firm* — I. Michael Bak-Boychuk

(57) ABSTRACT

A set of generally frustoconical panel segments dimensioned for a nested receipt within each other provides a support structure that is generally shaped as a tapered tie knot onto which variously colored and textured fabric pieces may be mounted to achieve distinctly appearing simulated necktie assemblies. A captured pin retains the segments and the cloth pieces together in a looped configuration that is easily adjusted to fit the user's neck.

4 Claims, 2 Drawing Sheets

(56) References Cited

U.S. PATENT DOCUMENTS

| | | | | |
|---|---|---|---|---|
| 2005/0066410 | A1* | 3/2005 | Jallard | 2/149 |
| 2005/0120461 | A1* | 6/2005 | Dickens | 2/144 |
| 2005/0204450 | A1* | 9/2005 | Dayan | 2/148 |
| 2006/0143781 | A1* | 7/2006 | Sato | 2/144 |
| 2007/0033703 | A1* | 2/2007 | Tao | 2/144 |
| 2008/0301850 | A1* | 12/2008 | Hooten | 2/148 |
| 2010/0050318 | A1* | 3/2010 | Johnston | 2/148 |
| 2010/0242152 | A1* | 9/2010 | Dayan | 2/148 |

* cited by examiner

APPARATUS FOR FORMING A SIMULATED NECKTIE

REFERENCE TO RELATED APPLICATIONS

This application claims the benefit of the earlier filing date of U.S. Provisional Application Ser. No. 61/962,623 filed on Nov. 12, 2013.

STATEMENT CONCERNING GOVERNMENT INTEREST

None.

BACKGROUND OF THE INVENTION

1. Field of the Invention

The present invention relates to a clamping support structure useful in simulating a necktie, and more particularly to a nested set of conical segments which capture the edges of variously colored fabric to simulate the appearance of a necktie knot of one selected texture and color that is then combined to appear as a knot forming part of a necktie comprising distinctly different textures and/or colors.

2. Description of the Prior Art

A common appearance of one's attire, personal ornamentation, or most frequently a necktie, are often adopted as identifying symbols, or distinctive markings, by various groups like fraternal organizations, sororities, youth organizations, student groups attending a particular school, and the like, in order to quickly distinguish their members by a unique and highly visible symbol. While sometimes used as uniforms, distinctly marked, articles of clothing are prone to progress towards our functional needs, leaving this distinguishing task to the last non-functional item, a necktie, which few have learned to properly tie, and even when its knotting is learned, leave limited options for combining visible texture and color combinations that are contrasted right at the edges of the knot.

In the past various mechanisms have been proposed which in one way or another seek to assist those unfamiliar with in the forming of a proper necktie knot exemplified by the teachings of U.S. Pat. No. 5,416,926 to Koy, U.S. Pat. No. 5,953,755 to Barylski, U.S. Pat. No. 6,094,746 to Miller, and others; illustrate structures that simply simulate a knot, as in U.S. Pat. No. 6,691,319 to Simon, U.S. Pat. No. 6,920,642 to Dickens, and others; or reform the necktie knot in a manner where it remains permanently tied while still allowing the necktie to be put on and removed, as in U.S. Pat. No. 3,737,917 to Orr. Each of the foregoing, while suitable for the purposes intended, provide little or no convenient facility to combine various colors and textures in a single necktie with the contrasting combination edges aligned right at the edges of the knot, to form a crisp delineation between the several colors and textures forming a symbolically distinctive article of clothing that emphasize the familiar shape of a necktie by its contrasting alignments.

A necktie knot shaped nested assembly that conveniently captures the edges of a cloth covering segment to create the appearance of a knot together with other fabric pieces shaped as the descending portion of the tie along with a neck strap is therefore extensively desired and it is one such assembly that is disclosed herein.

SUMMARY OF THE INVENTION

Accordingly, it is the general purpose and object of the present invention to provide a structure facilitating the assembly of various fabric pieces into a necktie by capturing the separate tie ends and the edges of a fabric piece forming the knot appearance between conformingly nested pieces to simulate a knotted necktie.

Other and further objects of the invention shall become apparent upon the examination of the description that follows in conjunction with the illustrations appended.

Briefly, these and other objects are accomplished within the present invention by providing a nested set of generally C-sectioned, longitudinally tapered interlocking conical segments or pieces between which both the end panels or straps of a necktie are captured together with the edges of a separate fabric panel covering the exterior piece to simulate the decorative aspects of a distinctly colored and textured necktie knot. The internally captured strap end portions of the tie may be joined together at a stiffened segment of a conforming planform that is receivable between the nested segments with the narrower strap then looped back to extend as an adjustable neck strap that is frictionally retained by the nested compression but nonetheless left sufficiently free to allow for a fitted adjustment around the wearer's neck.

Preferably each of the tapered and nested pieces is formed of a bendable sheet metal structure like sheet aluminum which once assembled in their nested form are then each pierced by a common drilling through which a fastening pin of a broche or medal is then passed once the necktie is assembled. It will be appreciated that the nesting offset of this common opening that results from the thickness increase attributable to the captured tie and knot fabrics will also provide a clamping effect, thus insuring a secure component engagement while still allowing strap adjusting movement for a good fit.

In this manner various color and texture combinations can be repeated to achieve a uniformly distinct necktie that can be conveniently assembled by those joining a group by way of an assembly facilitated by a minimal nested structure that is then fixed together by a pin that may also serve as an attachment for additional decorative items or insignia indicating tenure or rank.

DESCRIPTION OF THE PREFERRED EMBODIMENT

Figure 3:
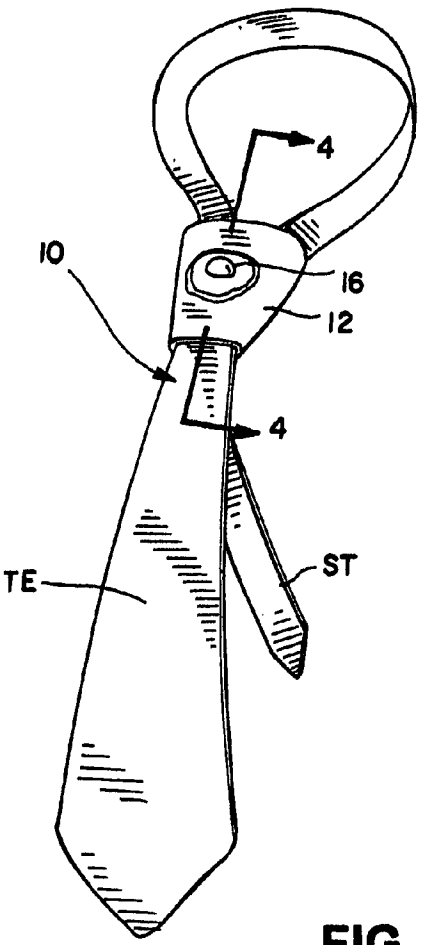
FIG. 3 is yet another perspective illustration of the inventive necktie simulating assembly in its completed form.
Figure 1:
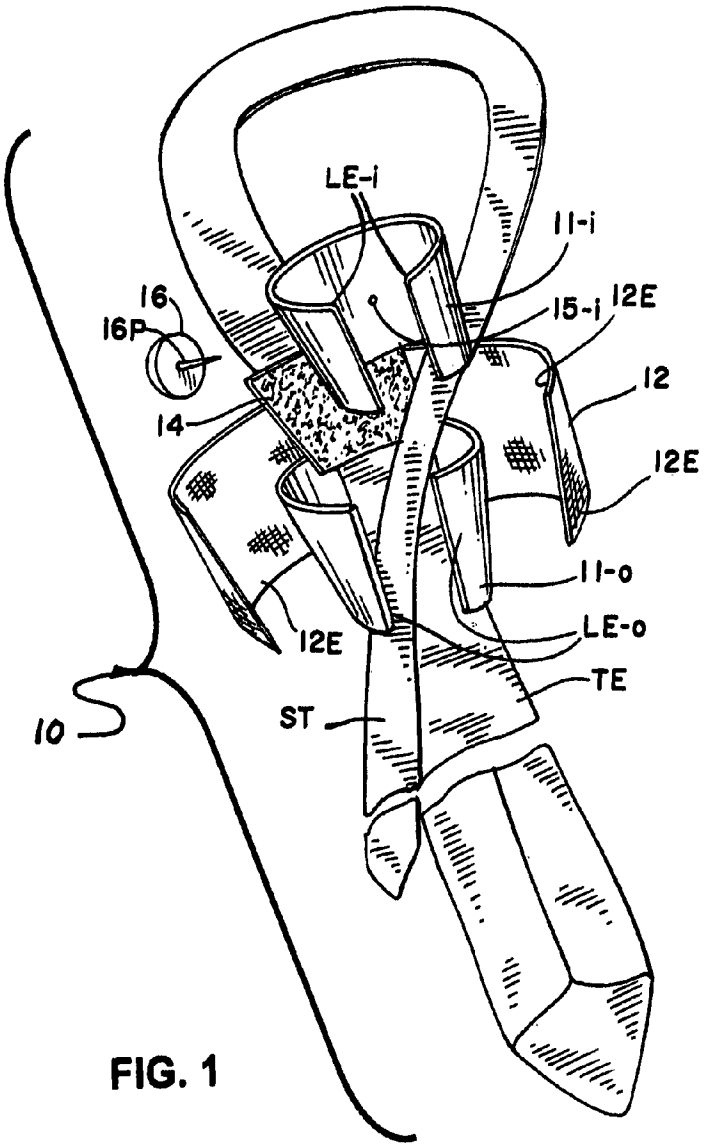
FIG. 1 is a perspective illustration, separated by parts, of the inventive necktie simulating assembly.
Figure 2:
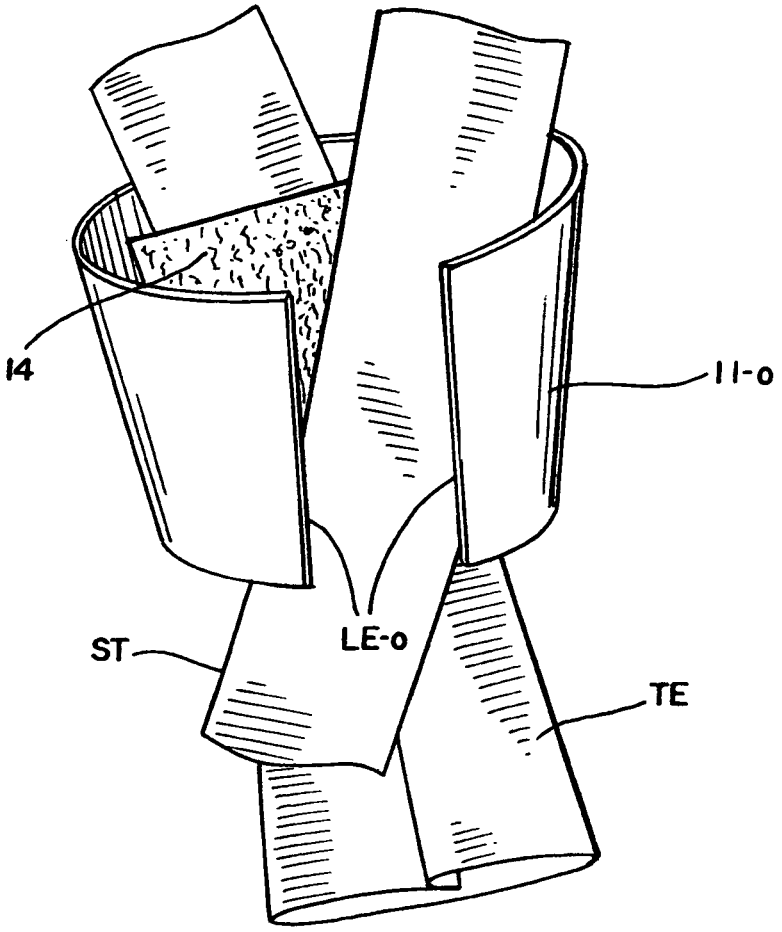
FIG. 2 is a further perspective illustration of the inventive necktie simulating assembly shown in FIG. 1 depicting the receiving side of the exterior piece of a nested support structure.
Figure 4:
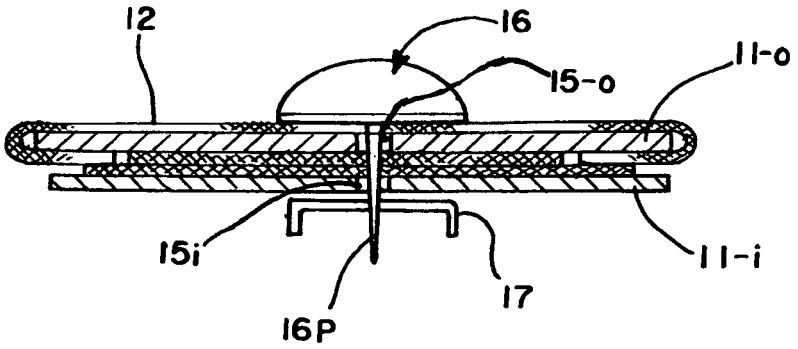
FIG. 4 is a sectional view taken along line 4-4 of FIG. 3, illustrating the engaged components of the inventive necktie simulating assembly.

As shown in FIGS. 1 through 4, the inventive necktie simulating assembly generally designated by the numeral 10 comprises an outer and inner, generally tapered frustoconical panel segment or piece 11-*o* and 11-*i* each provided with rolled-over lateral edges LE-o and LE-i dimensioned to define a space or gap between them that is conformed for a substantially matching nested receipt of the inner piece 11-*i* within the outer piece 11-*o*. Preferably, each of the nested pieces 11-*o* and 11-*i* are formed by rolled bending of corresponding generally trapezoidal exterior and interior metal panels, or sheets, to define a hollow interior space of a generally tapered conical frustum with the edges LE-o and LE-i of each panel, when nested in their frustoconical shape, overlying each other to define an access gap into the enclosed space which, on its panel exterior, approximates the general shape of a well-formed necktie knot.

In this form the nested combination of the inner and outer pieces is useful to grasp the peripheral edges 12E of a generally trapezoidal fabric piece 12 of planform dimensions greater than the panel planform of the outer piece 11-*o* where it remains captured between the outer piece and the inner piece 11-*i* to cover the outer piece with a separate fabric covering that is distinct from the remaining parts of the tie to present the appearance of a distinctly appearing tie knot that is crisply distinguished from the rest of the tie. To achieve the full benefit of this visual appearance a differently colored and textured tie end TE and strap ST are then each stitched at their hidden portions to one side of a common trapezoidal fabric piece 14 with the strap ST then looped back onto the other side of piece 14 to form a loop when the piece captured by the inner piece 11-*i*.

It will be appreciated that the tapering nested fit of the inner piece 11-*i* within the outer piece 11-*o* will produce an increasing capturing force between them as the inner piece is advanced further into the outer piece. Thus a predictably secure capturing engagement retaining the covering cloth 12 edges 12E, the fabric piece 12 and the tie end TE can be achieved by way the positioning of alignment drillings 15-*o* and 15-*i* respectively in the outer piece 11-*o* and the inner piece 11-*i* through which a common fastening pin 16P of a broche or insignia 16 is inserted to be then secured by a securement clip 17, thus aligning the desired depth of nested receipt and therefore the lavel of capturing retention. Of course, the off-center alignment of the strap ST assures that its adjustable function remains in tact, allowing for the adjustment convenience assuring a comfortable fit around the user's neck.

In this manner a well defined color and texture combination of a necktie is assured which, in view of the generally fixed structure of the knot defining portion repeatably assures a well-formed knot of one selected texture and color that is then combined with a tie end of the desired distinct texture and color to properly distinguish a fraternal organization, a business enterprise and so on. Significantly, this same distinct appearance is always associated with a well-formed and neatly defined knot.

Obviously many modifications and variations of the instant invention can be effected without departing from the spirit of the teachings herein. It is therefore intended that the scope of the invention be determined solely by the claims appended hereto.

It is claimed:

1. A nested assembly useful for securing a plurality of separate fabric pieces to simulate the appearance of a necktie, comprising:

an outer, generally planar piece convolved as a frustoconical surface segment defined by an upper edge spaced from a generally parallel lower edge to form a generally tapered portion of said frustoconical surface segment extending between opposing rolled-over lateral edges separated by a gap communicating into an interior space;

an inner, generally planar piece convolved as a frustoconical surface segment shaped for nested receipt within said interior space in a generally conforming alignment adjacent said outer piece, said outer and inner pieces each further respectively including an outer perforation and an inner perforation coaxially aligned upon said nested receipt of said inner piece in said outer piece;

a first cloth segment of a planform having a greater dimension than said outer piece and including a peripheral portion receivable between said outer and inner pieces upon said nested receipt thereof; and a pin assembly including a pointed end and a releasable clasp engageable to said pointed end and coaxially receivable in said outer and inner perforations while piercing through said first cloth segment upon said nested receipt of said inner piece in said outer piece.

2. A nested assembly according to claim 1, further comprising:

a second cloth segment of a generally tapered elongate planform defined by a larger end and a smaller end received between said outer and inner pieces in a looped arrangement conformed for an adjustable fit around a user's neck.

3. A nested assembly according to claim 2, wherein;

said second cloth segment further includes a cloth panel of a planform receivable between said outer and inner pieces when aligned by said pin assembly.

4. A nested assembly according to claim 3, wherein:

said smaller end of said second cloth segment is received for sliding translation between said inner and outer piece.

* * * * *